US008248347B2

(12) United States Patent
Chen et al.

(10) Patent No.: US 8,248,347 B2
(45) Date of Patent: Aug. 21, 2012

(54) FIELD SEQUENTIAL LCD DRIVING METHOD

(75) Inventors: Po-Yang Chen, Tainan (TW); Po-Sheng Shih, Hsinchu (TW); Sweehan Jui-Hsien Yang, Tainan (TW)

(73) Assignee: HannStar Display Corporation, Taipei (TW)

( * ) Notice: Subject to any disclaimer, the term of this patent is extended or adjusted under 35 U.S.C. 154(b) by 748 days.

(21) Appl. No.: 12/324,859

(22) Filed: Nov. 27, 2008

(65) Prior Publication Data

US 2009/0207117 A1 Aug. 20, 2009

(30) Foreign Application Priority Data

Feb. 18, 2008 (TW) ..... 97105632 A

(51) Int. Cl.
*G09G 3/36* (2006.01)

(52) U.S. Cl. ..... 345/96; 345/102
(58) Field of Classification Search ..... None
See application file for complete search history.

(56) References Cited

U.S. PATENT DOCUMENTS

| | | | | |
|---|---|---|---|---|
| 6,819,311 | B2 * | 11/2004 | Nose et al. | 345/100 |
| 7,038,651 | B2 * | 5/2006 | Nitta et al. | 345/98 |
| 7,609,245 | B2 * | 10/2009 | Kasai | 345/89 |
| 2007/0229432 | A1 * | 10/2007 | Kimura | 345/96 |

* cited by examiner

*Primary Examiner* — Jason Olson
(74) *Attorney, Agent, or Firm* — CKC & Partners Co., Ltd.

(57) ABSTRACT

The present invention discloses a driving method for a liquid crystal display. The liquid crystal display has a plurality of pixels arranged in a matrix form. The method includes the following steps. The first step is to write black data to the pixels using an over driving voltage. The second step is to select partial of the pixels or all pixels to write color data based on a color image signal. The third step is to turn on the corresponding backlight based on the color data.

19 Claims, 6 Drawing Sheets

Frame N
Columns

| Lines | 1 | 2 | 3 | 4 | 5 |
|---|---|---|---|---|---|
| 1 | + | + | + | + | + |
| 2 | + | + | + | + | + |
| 3 | + | + | + | + | + |
| 4 | + | + | + | + | + |
| 5 | + | + | + | + | + |

Frame N+1
Columns

| Lines | 1 | 2 | 3 | 4 | 5 |
|---|---|---|---|---|---|
| 1 | — | — | — | — | — |
| 2 | — | — | — | — | — |
| 3 | — | — | — | — | — |
| 4 | — | — | — | — | — |
| 5 | — | — | — | — | — |

Fig. 5A

Frame N
Columns

| Lines | 1 | 2 | 3 | 4 | 5 |
|---|---|---|---|---|---|
| 1 | + | — | + | — | + |
| 2 | + | — | + | — | + |
| 3 | + | — | + | — | + |
| 4 | + | — | + | — | + |
| 5 | + | — | + | — | + |

Frame N+1
Columns

| Lines | 1 | 2 | 3 | 4 | 5 |
|---|---|---|---|---|---|
| 1 | — | + | — | + | — |
| 2 | — | + | — | + | — |
| 3 | — | + | — | + | — |
| 4 | — | + | — | + | — |
| 5 | — | + | — | + | — |

Fig. 5B

Frame N
Columns

| Lines | 1 | 2 | 3 | 4 | 5 |
|---|---|---|---|---|---|
| 1 | + | + | + | + | + |
| 2 | — | — | — | — | — |
| 3 | + | + | + | + | + |
| 4 | — | — | — | — | — |
| 5 | + | + | + | + | + |

Frame N+1
Columns

| Lines | 1 | 2 | 3 | 4 | 5 |
|---|---|---|---|---|---|
| 1 | — | — | — | — | — |
| 2 | + | + | + | + | + |
| 3 | — | — | — | — | — |
| 4 | + | + | + | + | + |
| 5 | — | — | — | — | — |

Fig. 5C

Frame N
Columns

| Lines | 1 | 2 | 3 | 4 | 5 |
|---|---|---|---|---|---|
| 1 | + | — | + | — | + |
| 2 | — | + | — | + | — |
| 3 | + | — | + | — | + |
| 4 | — | + | — | + | — |
| 5 | + | — | + | — | + |

Frame N+1
Columns

| Lines | 1 | 2 | 3 | 4 | 5 |
|---|---|---|---|---|---|
| 1 | — | + | — | + | — |
| 2 | + | — | + | — | + |
| 3 | — | + | — | + | — |
| 4 | + | — | + | — | + |
| 5 | + | — | + | — | + |

Fig. 5D

FIELD SEQUENTIAL LCD DRIVING METHOD

RELATED APPLICATIONS

This application claims priority to Taiwan Application Serial Number 97105632, filed Feb. 18, 2008, which is herein incorporated by reference.

FIELD OF THE INVENTION

The present invention relates to a LCD driving method, and especially to a field sequential LCD driving method.

BACKGROUND OF THE INVENTION

Generally, methods for driving an LCD can be classified into two methods, the color filter method and the field-sequential driving method, based on methods of displaying color images.

The color filter method divides a pixel into three sub-pixels that corresponds to red resist, green resist and blue resist respectively to compose a color. The color sequential method sequentially switches three primary colors within the time humans do not perceive the flicker of the image to compose a color. That is, the primary colors are sequentially displayed in three time segments. Therefore, a complete color image is displayed as a rapidly changing sequence of primary monochrome images. Since every pixel unit in the display contributes to every primary image, a color sequential imaging display must address the pixel units first to select required pixel units to display.

Typically, since three primary colors are sequentially switched in three time segments in the color sequential method, liquid crystal molecules have to be rotated from the prior primary color to the present primary color. Therefore, the rotated angle of the prior primary color influences the rotated angle of the present primary color. For example, when two pixels with different primary colors in the prior frame are changed to the same primary color in the present frame, a color difference exists in the two pixels since the liquid crystal molecules in the two pixels are rotated from different start angles. This can reduce the display quality.

To resolve the foregoing problem, black data is first written into each pixel to reset the liquid crystal molecules to confirm the liquid crystal molecules in each pixel are rotated from the same start angle. FIG. 1 illustrates the driving scheme. A frame is separated to three sub-frames, including red sub-frame (R-SF), green sub-frame (G-SF) and blue sub-frame (B-SF) to sequentially show three primary colors, red, green and blue, in the persistence of vision time. The three primary colors within the time that humans do not perceive the flicker of image to compose a color. Each sub-frame of the drive scheme has four intervals. During the first interval 101 black data is written into each pixel to reset the liquid crystal molecules. In the second interval 102 addresses are assigned to the pixels for writing color data into pixels. The third interval 103 is the response time of the liquid crystal molecules. During the fourth interval 104 the corresponding backlight is turned on based on the corresponding color data. The fourth interval 104 is the critical interval. When the fourth interval 104 is too short to completely turn on the backlight, the brightness of the panel is reduced, which will influence the panel quality.

Therefore, it is the objective for a designer to lengthen the fourth interval to increase the brightness to improve the quality

SUMMARY OF THE INVENTION

Therefore, the invention is to solve the foregoing problem. An over driving method is adopted to reduce the interval of writing black data into each pixel to lengthen the interval to turn on the backlight.

In accordance with the foregoing purpose, the present invention discloses a driving method for a liquid crystal display. The liquid crystal display has a plurality of pixels arranged in a matrix form. The method includes the following steps. The first step is to write black data to the pixels using an over driving voltage. The second step is to select some of the pixels or all the pixels to write color data based on a color image signal. The third step is to turn on the corresponding backlight based on the color data.

The present invention also discloses a driving method for a liquid crystal display. This method groups the gate lines of the liquid crystal display into two groups in the interval where the black signal is written to the pixel. The two groups are driven at different times, wherein the black data is written into the pixels through data lines. An over driving voltage is adopted to write the black data to the pixels.

The interval to write black data to each pixel is reduced because an over driving voltage is adopted to write the black data. Therefore, the interval to turn on the backlight is lengthened to improve the brightness of panel.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 5A illustrates a frame inversion driving method.

FIG. 5B illustrates a column inversion driving method.

FIG. 5C illustrates a row inversion driving method.

FIG. 5D illustrates a dot inversion driving method.

DETAILED DESCRIPTION OF THE PREFERRED EMBODIMENTS

Figure 1:
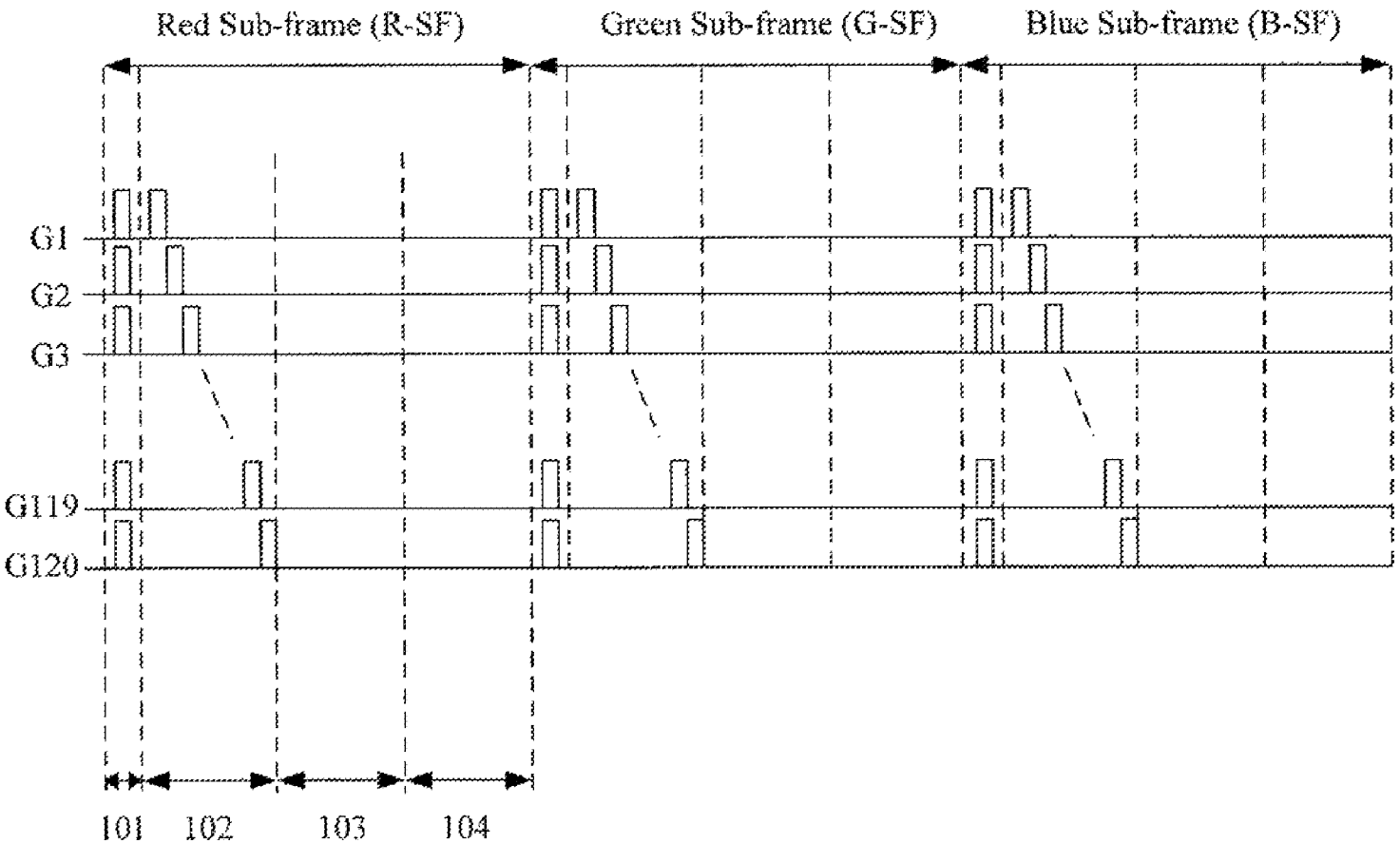
Fig. 1 (Prior Art)
FIG. 1 illustrates a driving scheme of a conventional field sequential LCD.

An over driving method is adopted in the present invention to reduce the interval of writing black signals and to increase the interval to turn on the backlight. Such a method can resolve the low brightness problem that the interval to turn on the backlight is too short. This method can be applied to different types of LCD, such as the OCB mode LCD. Reference will now be made in detail to the present preferred embodiments of the invention, examples of which are illustrated in the accompanying drawings. Wherever possible, the same reference numbers are used in the drawings and the description to refer to the same or like parts.

Figure 2:
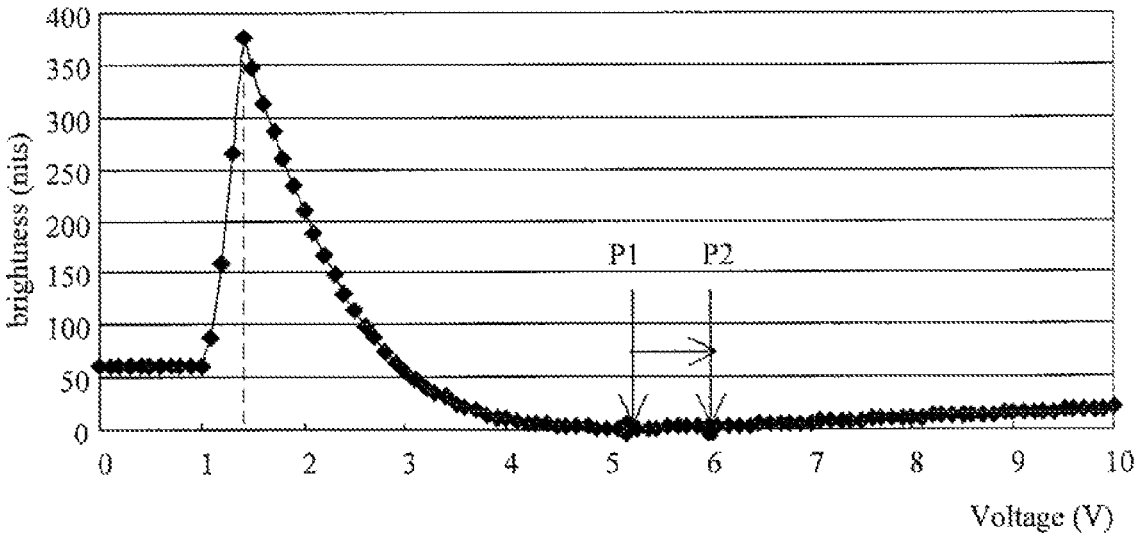
FIG. 2 illustrates a relationship diagram of brightness to driving voltage.

FIG. 2 illustrates a relationship diagram of brightness to driving voltage. When the voltage value P1 applied to the liquid crystal molecules, for example 5 volts, the brightness of the LCD is just to zero. That is that the critical voltage value P1 rotates the liquid crystal molecules to a special angle to just block the backlight. In other words, the critical voltage P1 is the minimum voltage which makes the liquid crystal molecules of the pixels rotate to a special angle to just block the backlight. At this time, a black picture is displayed on the LCD. Therefore, the voltage value P1 is the voltage usually applied to the first interval 101 to write black data as described in the FIG. 1. The black data is considered a reset signal to rotate the liquid crystal molecules to this special angle. However, through the experiments, the rotating velocity of the liquid crystal molecules is approximately proportional to the voltage applied to the liquid crystal molecules. A larger voltage applied to the liquid crystal molecules can reduce the waiting time for the liquid crystal molecules to rotate their destination direction or position. Therefore, in the present invention, a voltage value P2 that is larger than the critical voltage value P1 is adopted to over drive the liquid crystal molecules to write black data to the pixels. This voltage value P2 can accelerate the liquid crystal molecules to rapidly arrive the special angle and even over it to reduce the interval to write a black signal and to increase the interval for turning on the backlight. Although the voltage value P2 rotates the liquid crystal molecules over the special angle on which the backlight is just blocked, it is acceptable because the backlight is turned off when the black data is being written. That is that the over driving method does not influence the display quality in the first interval 101.

Figure 3:
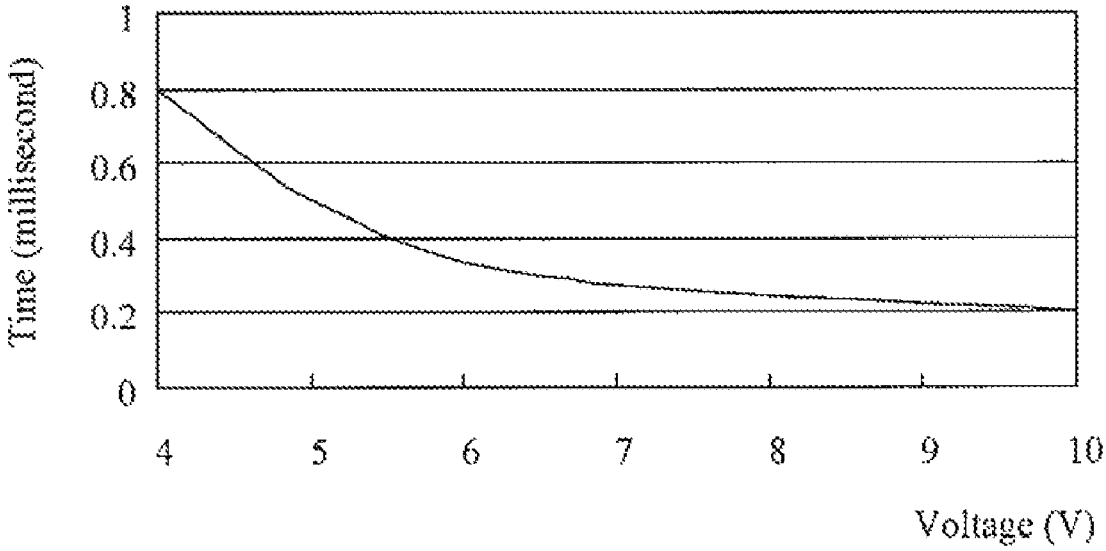
FIG. 3 illustrates a time chart for a LCD from color state to black state.

FIG. 3 illustrates a time chart for a LCD from color state to black state. This figure also illustrates the relationship of the voltage applied to the liquid crystal molecules to the time for the liquid crystal molecules rotating to the same corresponding stable angle. The time for a 5-volt voltage applied to the liquid crystal molecules for rotating to the stable angle is 0.5 millisecond. The time for an 8-volt voltage applied to the liquid crystal molecules to rotate to the stable angle is 0.25 milliseconds. Therefore, the time for rotating the liquid crystal molecules to the corresponding stable angle is inversely proportional to the voltage applied to the liquid crystal molecules. In the present invention, the over driving voltage for writing black data to pixels is larger than the critical voltage for rotating the liquid crystal molecules to just block the backlight, but less than the maximum voltage which can be provided by the source driver. In an embodiment, the over driving voltage is between 4 volts to 12 volts. The preferred over driving voltage is between 5 volts and 10 volts. Moreover, the larger the voltage applied to the liquid crystal molecules is, the more uniform the arrangement of the liquid crystal molecules is. Therefore, when an over driving voltage is applied to the liquid crystal molecules for writing black data, the liquid crystal molecules are uniformly arranged at a stable angle. Next, after the interval 101, partial or all pixels, i.e. at least some of the pixels, are selected to write color data based on a color image signal. The color image signal are usually includes a red image signal, a blue image signal and a green image signal to construct a color picture. Then, the corresponding backlight is turned-on based on the color data.

Typically, an LCD includes a pixel matrix substrate, a color filter substrate, a common electrode disposed on the color filter substrate and a liquid crystal molecule layer disposed between the pixel matrix substrate and the color filter substrate. Data lines and gate lines are arranged in the pixel matrix substrate to define pixels. The liquid crystal molecule corresponding to a pixel is disposed between the common electrode and the pixel electrode. According to the embodiment, the voltage, such as the over driving voltage, applied to the liquid crystal molecules is the voltage difference between the pixel electrode and the common electrode. In another embodiment, when the voltage of the common electrode is fixed, the over driving voltage is increased by enlarging the output data voltage range of the source driver. The enlarged output data voltage is then transferred to the pixel electrode. In other words, in this embodiment, the over driving voltage can be modified and controlled only by the source driver. However, such source drivers need to generate high voltage. The manufacturing cost of the source driver which can provide a large output data voltage is high. To resolve the high-cost problem of the source drive, in another embodiment, the common electrode voltage is oppositely (or reversely) changed corresponding to the output data voltage change of the source driver. According to this embodiment, the voltage difference between the common electrode voltage and the output data voltage is the driving voltage for a pixel. Such a method can reduce the output data voltage of the source driver since the common electrode voltage and the output data voltage are reversed to each other.

Figure 4B:
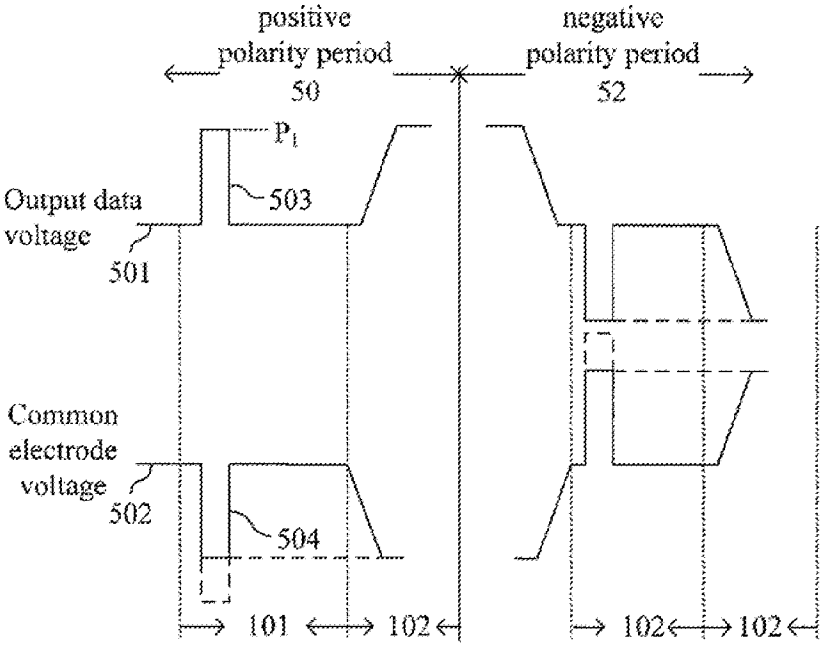
FIG. 4B illustrates an over driving waveform for writing black data according to another preferred embodiment of the present invention.
Figure 4A:
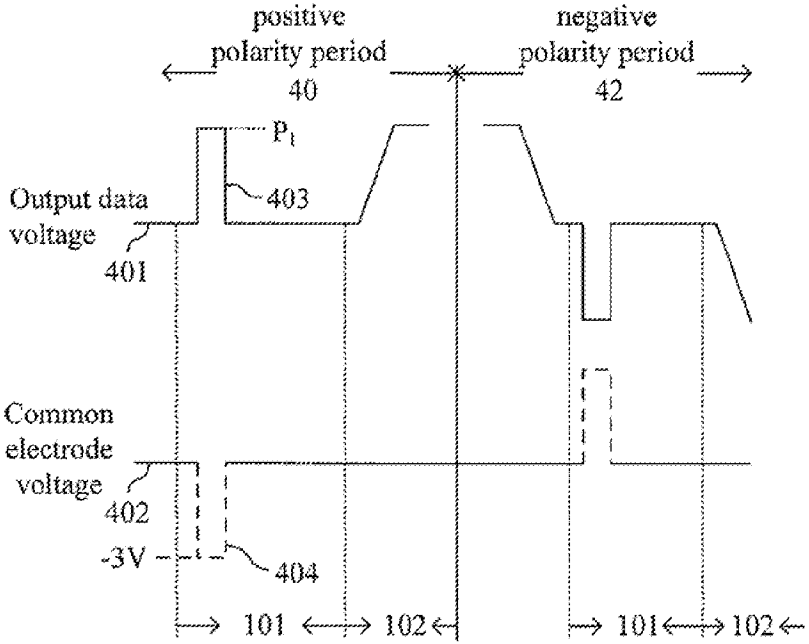
FIG. 4A illustrates an over driving waveform for writing black data according to a preferred embodiment of the present invention.

FIG. 4A illustrates an over driving waveform for writing black data according to a preferred embodiment of the present invention. In this embodiment, the over driving voltage is the voltage difference between the pixel electrode voltage and the common electrode voltage. FIG. 4A only draws the interval 101 for writing black data and the interval 102 for addressing the pixels in the positive polarity period 40 and the negative polarity period 42. Excluding the voltage direction, the positive polarity period 40 and the negative polarity period 42 have same driving method. The driving waveform in the positive polarity period 40 is described in detail in the following. The driving waveform in the negative polarity period 42 can be deduced by analogy.

In accordance with an embodiment, in the interval 101 of the positive polarity period 40, the source driver changes the output data voltage from voltage level 401 to voltage waveform 403 while the common electrode voltage is changed from voltage level 402 to voltage waveform 404 to write black data. The output data voltage supplies to the pixel electrode. The common electrode voltage and the output data voltage are oppositely changed to each other. The voltage difference between the common electrode voltage and the output data voltage is the driving voltage for a pixel. In other words, in this embodiment, the source driver only needs to generate the output data voltage with voltage value P1. The reversed changed common electrode voltage, such as the voltage waveform 404, can compensate the output data voltage, such as the voltage waveform 403, to form the over driving voltage. For example, the required over driving voltage is 8 volt. The source driver can generate maximum output data voltage, such as the voltage value P1, is 5 volts. The voltage difference between the over driving voltage and the maximum output data voltage is 3 volts. In this cases the common electrode voltage 402 is reversed changed to −3 volts, such as the voltage waveform 404, to compensate for the voltage difference to accordingly produce the required over driving voltage, 8 volt. Therefore, in this embodiment, it is not necessary to use a high cost source driver for generating high output data voltage.

On the other hand, the common electrode connects to a changeable power supply to vary the common electrode voltage. Therefore, the over driving voltage is also increased by increasing the common electrode voltage. FIG. 4B illustrates an over driving waveform for writing black data according to another preferred embodiment of the present invention. The main difference between the FIG. 4A and FIG. 4B is that the common electrode is connected to a changeable power supply in FIG. 4B. FIG. 4B only draws the interval 101 for writing black data and the interval 102 for addressing the pixels in the positive polarity period 50 and the negative polarity period 52. Excluded the voltage direction, the positive polarity period 50 and the negative polarity period 52 have same driving method. The driving waveform in the positive polarity period 50 is described in detail in the following. The driving waveform in the negative polarity period 52 can be deduced by analogy.

In accordance with an embodiment, in the interval 101 of the positive polarity period 50, the source driver changes the output data voltage from voltage level 501 to voltage waveform 503 while the common electrode voltage is changed from voltage level 502 to voltage waveform 504 to write black data. The output data voltage supplies the pixel electrode. The common electrode voltage and the output data voltage are reversely changed to each other. The reversed changed common electrode voltage, such as the voltage waveform 504, can compensate the output data voltage, such as the voltage waveform 503, to form the over driving voltage. The required change of the common electrode voltage is related to the required over driving voltage and the maximum output data voltage that the source driver can provide. For example, the required over driving voltage is 8 volts. The source driver can generate maximum output data voltage, such as the voltage value P1, is 5 volt. The voltage difference between the over driving voltage and the maximum output data voltage is 3 volts. In this case, the common electrode voltage 502 is reversed changed to −3 volts to compensate for the voltage difference. Therefore, in this embodiment, it is not necessary to use a high cost source driver for generating high output data voltage.

To prevent the liquid crystal molecules from being subjected to a voltage bias of single polarity and therefore shortening the life of the liquid crystal molecules, a single display cell in the Liquid crystal display is driven by video signals of opposite polarities in the odd-numbered video frames and even-numbered video frames. There are four driving schemes that achieve the above-described requirement, including frame inversion in FIG. 5A, column-inversion in FIG. 5B, row inversion in FIG. 5C and dot-inversion in FIG. 5D.

In the frame inversion, as illustrated in FIG. 5A, the polarity of the voltage applied to the pixel electrodes is reversed in every frame. In the column inversion, as illustrated in FIG. 5B, the polarity of voltage applied to the pixel electrodes is reversed in every data line (column). In the row inversion, as illustrated in FIG. 5C, the polarity of voltage applied to the pixel electrodes is reversed in every scan line (row). In the dot inversion method, as illustrated in FIG. 5D, the polarity of voltage is reversed in adjacent scan lines and data lines.

The four driving schemes can adopt the over driving method for writing black data in a liquid crystal display according to the present invention. The driving schemes of row inversion and dot inversion is described in detail in the following. The driving schemes of frame inversion and column inversion can be deduced by analogy.

Figure 6A:
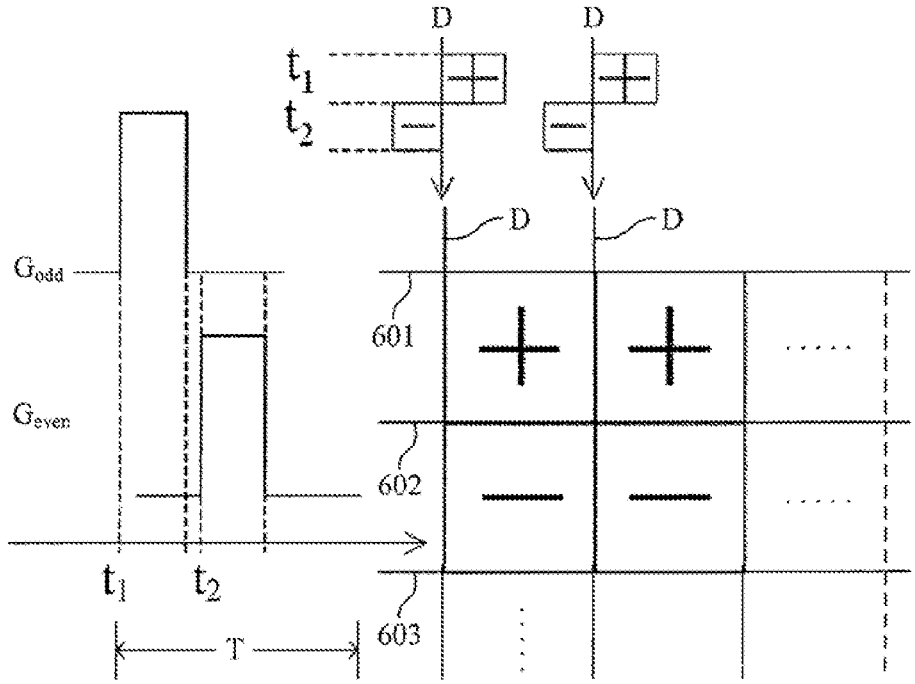
FIG. 6A illustrates a method for writing black data using a row inversion driving method.

FIG. 6A illustrates a method for writing black data using a row inversion driving method. FIG. 6A only illustrates four adjacent pixels. First, at time t1 in the interval T for writing black data, the driving signal of the odd-numbered gate electrodes $G_{odd}$ is in a high level state, and the driving signal of even-numbered gate electrodes $G_{even}$ is in a low level state. At this time, the switches coupled with the odd-numbered gate lines 601 and 603 are turned on. The positive polarity data voltage in the data lines D are transferred to the pixel electrodes through the switches. The positive polarity data voltage and the common electrode voltage constructs the over driving voltage to write black data to the pixels. Next, at time t2 in the interval T for writing black data, the driving signal of the odd-numbered gate electrode $G_{odd}$ is in a low level state, the driving signal of the even-numbered gate electrodes $G_{even}$ is in a high level state. At this time, the switches coupled with the even-numbered gate line 602 are turned on. The negative polarity data voltage in the data line D is transferred to the pixel electrode through the switch. The negative polarity data voltage and the common electrode voltage constructs the over driving voltage to write black data to pixels.

Accordingly, in the interval T for writing black data, by controlling the turning on time of the odd-numbered and even-numbered switches and the polarity of the data voltage transferred to the pixel electrode, the polarity of voltage applied to the pixel electrodes is reversed on every scan line, which is a row inversion driving scheme. It is noticed that the polarity of the black data in the interval 101 (as shown in FIG. 1) of the present frame and the polarity of the color data in the interval 102~104 (as shown in FIG. 1) of the present frame are arranged to be the same in the FIG. 6A. Therefore, it is not necessary for the source driver to supply much power to drive the liquid crystal molecules from a first (previous) polarity in a previous frame, such as a positive polarity, to a second (following) polarity in a present frame, such as a negative polarity. Furthermore, such polarity design also can help the liquid crystal molecules rotate to destination positions quickly, which can reduce the interval for addressing pixels.

Therefore, in this embodiment as shown in FIG. 6A, the gate lines are grouped into two groups, the odd-numbered gate lines and the even-numbered gate lines arranged in alternative lines. All the odd-numbered gate line are driven at the same time t1 and all the even-numbered gate lines are driven at the same time t2, that is the odd-numbered gate lines and the even-numbered gate lines are driven at different times and cooperate with corresponding data voltage via data lines to write black data to pixels respectively. The polarity of the black data of the present frame and the polarity of the color data of the present frame are arranged to be the same so that the velocity of writing color data to pixels can be improved to reduce the interval for addressing pixels. Moreover, the driving method of this embodiment adopts an over driving voltage to write black data to pixels. However, in another embodiments, the driving method of this embodiment can adopt a typical method without employing an over driving voltage to write black data to pixels.

Figure 6B:
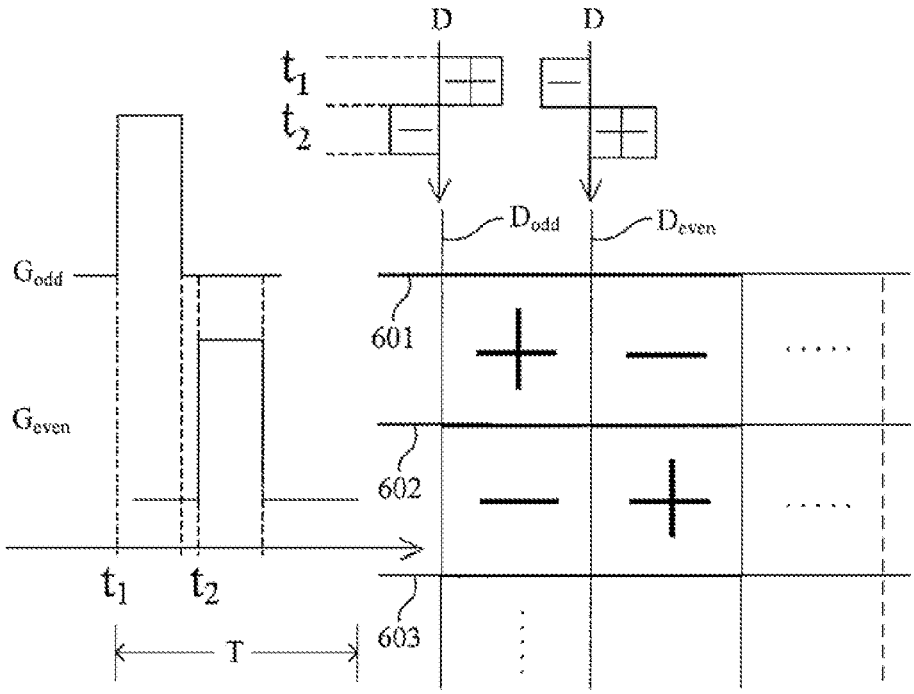
FIG. 6B illustrates a method for writing black data using a dot inversion driving method.

FIG. 6B illustrates a method for writing black data using a dot inversion driving method. FIG. 6B only illustrates four adjacent pixels. First, at time t1 in the interval T for writing black data, the driving signal of the odd-numbered gate electrodes $G_{odd}$ is in a high level state, and the driving signal of the even-numbered gate electrodes $G_{even}$ is in a low level state. At this time, the switches coupled with the odd-numbered gate lines 601 and 603 are turned on. The positive polarity data voltage in the odd-numbered data lines $D_{odd}$ and the negative polarity data voltage in the even-numbered data lines $D_{even}$ are transferred to the pixel electrodes through the switches. The data voltage and the common electrode voltage constructs the over driving voltage to write black data to pixels. Next, at time t2 in the interval T for writing black data, the driving signal of the odd-numbered gate electrodes $G_{odd}$ is in a low level state, and the driving signal of the even-numbered gate electrodes $G_{even}$ is in a high level state. At this time, the switches coupled with the even-numbered gate line 602 are turned on. The negative polarity data voltage in the odd-numbered data lines $D_{odd}$ and the positive polarity data voltage in the even-numbered data lines $D_{even}$ are transferred to the pixel electrodes through the switch to write black data to pixels.

Accordingly, in the interval T for writing black data, the polarity of voltage applied to the pixel electrodes is reversed at every scan line and data line, which is a dot inversion driving scheme. It is noticed that the polarity of the black data in the interval 101 (as shown in FIG. 1) of the present frame and the polarity of the color data in the interval 101 (as shown in FIG. 1) of the present frame are arranged to be the same. Therefore, it is not necessary for the source driver to supply much power to drive the liquid crystal molecules from a first (previous) polarity in a previous frame, such as a positive polarity, to a second (following) polarity in a present frame, such as a negative polarity. Such polarity design also can help the liquid crystal molecules rotate to destination positions quickly, which can reduce the interval for addressing pixels.

Therefore, in this embodiment, in the interval T for writing black data, by controlling the turning on time of the odd-numbered and even-numbered gate lines' switches and the polarity of the data voltage in the odd-numbered and even-numbered data lines, the polarity of voltage applied to the pixel electrodes is reversed on every scan line and data line, which is a dot inversion driving scheme. That is that the data lines are grouped into two groups, the odd-numbered data lines and the even-numbered data lines. Moreover, the driving method of the embodiment adopts an over driving voltage to write black data to pixels. In another embodiments, the driving method of the present embodiment can adopt a typical method without employing an over driving voltage to write black data to pixels.

In the embodiments illustrated in FIG. 6A and FIG. 6B, the gate lines are grouped into two groups, the group of odd-numbered gate lines and the group of even-numbered gate lines. However, in other embodiments, the gate lines can be grouped by other methods and cooperate with corresponding data line signals via data lines to write black data to the pixels. For example, in an embodiment, the frame inversion driving scheme is applied to a LCD. In this case, all gate lines are grouped and driven together so as to cooperate with the data line signal to write same polarity black data to the pixels. In a preferred embodiment, the polarity of the black data in the present frame and the polarity of the color data in the same frame are same. On the other embodiments, the gate lines are grouped into several groups which more than two groups and cooperate with different data line signals to write black data to the pixels.

Accordingly, the present invention discloses a driving method for a liquid crystal display. The driving method uses an over driving voltage to write black data to pixels of the liquid crystal display. After the black data is written into the pixels, partial or all pixels (i.e. at least some of the pixels) are selected to write color data based on a color image signal (red image signal, blue image signal or green image signal). Such method can reduce the interval to write black data to pixels and increase the interval to turn on the corresponding backlight so that the brightness of the LCD can be improved. On the other hand, the present invention also discloses a driving method for a liquid crystal display. This method groups the gate lines of the liquid crystal display into two groups or more in the interval for writing black data. The gate lines of two groups are driven in different times respectively, wherein black data is written into pixels through data lines and an over driving voltage is adopted to write the black data to the pixels.

As is understood by a person skilled in the art, the foregoing descriptions of the preferred embodiment of the present invention are an illustration of the present invention rather than a limitation thereof. Various modifications and similar arrangements are included within the spirit and scope of the appended claims. The scope of the claims should be accorded to the broadest interpretation so as to encompass all such modifications and similar structures.

What is claimed is:

1. A driving method for a liquid crystal display, the liquid crystal display includes a first substrate, a second substrate, a plurality of data lines, a plurality of gate lines and a liquid crystal molecule layer between the first substrate and the second substrate, wherein the plurality of data lines and the plurality of gate lines are disposed on the first substrate to define a plurality of pixels and a common electrode disposed on the second substrate, the method comprising the steps:

using an over driving voltage to write black data to the pixels, the over driving voltage is larger than a critical voltage which makes the liquid crystal molecules of the liquid crystal molecule layer rotate to a special angle to just completely block the backlight to make a brightness from the backlight to the pixels be exactly equal to zero and makes the pixels display just complete black image, wherein using an over driving voltage to write black data to the pixels in the black image writing period further comprises:

transferring a data voltage to pixel electrodes of the pixels through the data lines; and changing the common electrode's voltage from a first voltage to a second voltage, wherein a voltage difference between the second voltage and the data voltage is the over driving voltage, wherein the polarity of the data voltage is reversed to the polarity of the second voltage;

selecting at least some of the pixels to write color data based on a color image signal after the black data is written into the pixels; and turning on a backlight based on the color data.

2. The driving method of claim 1, wherein a polarity of the black data is same as a polarity of the color data in the selected pixels.

3. The driving method of claim 1, wherein a frame inversion driving scheme, a column-inversion driving scheme, a row inversion driving scheme or a dot-inversion driving scheme is adopted to write the black data to the pixels.

4. The driving method of claim 1, wherein the gate lines are grouped into a first group and a second group, the gate lines of the first group are driven in a first time and the gate lines of the second group are driven in a second time to write the black data to the pixels.

5. The driving method of claim 4, wherein the gate lines of the first group and the gate lines of the second group are arranged in alternative lines.

6. The driving method of claim 4, further comprising to transfer the black data with a first polarity to the pixels in the first time through the data lines, and to transfer the black data with a second polarity reversed to the first polarity to the pixels in the second time through the data lines.

7. The driving method of claim 4, wherein the gate lines of the first group are the odd-numbered gate lines, and the gate lines of the second group are the even-numbered gate lines.

8. The driving method of claim 4, wherein the data lines are grouped into a first group and a second group, the data lines of the first group transfers the black data with a first polarity and the data lines of the second groups transfers the black data with a second polarity to the pixels in the first time, and the data lines of the first group transfers the black data with the second polarity and the data lines of the second groups transfers the black data with the first polarity to the pixels in the second time, wherein the first polarity is reversed to the second polarity.

9. The driving method of claim 8, wherein the data lines of the first group, and the data lines of the second group are arranged in alternative lines.

10. The driving method of claim 1, wherein the step of using an over driving voltage to write black data to the pixels further comprises to select and drive the gate lines to write the black data at the same time.

11. The driving method of claim 10, wherein the data lines are grouped into a first group and a second group, the data lines of the first group transfers the black data with a first polarity and the data lines of the second groups transfers the black data with a second polarity to the pixels at the same time, wherein the first polarity is reversed to the second polarity.

12. The driving method of claim 1, wherein the color image signal includes a red image signal, a blue image signal and a green image signal.

13. The driving method of claim 1, wherein the step of using an over driving voltage to write black data to the pixels further comprises to transfer the over driving voltage to the pixels through the data lines.

14. The driving method of claim 1, wherein the liquid crystal display is an Optical Compensated Bend (OCB) mode liquid crystal display.

15. The driving method of claim 1, wherein the over driving voltage is 4~12 volt.

16. A driving method for a liquid crystal display, the liquid crystal display includes a plurality of data lines and a plurality of gate lines and a plurality of pixels defined by the plurality of data lines and the plurality of gate lines, the method comprising the steps:

grouping the gate lines into a first group and a second group;

driving the gate lines of' the first group in a first time and driving the gate lines of the second group in a second time, and writing black data to the pixels through the data lines, wherein an over driving voltage is used to write the black data to the pixels, the over driving voltage is larger than a critical voltage which makes the liquid crystal molecules of the liquid crystal molecule layer rotate to a special angle to just completely block the backlight to make a brightness from the backlight to the pixels be exactly equal to zero and makes the pixels display just complete black image, wherein writing black data to the pixels in the black image writing period further comprises:

transferring a data voltage to pixels; and changing a common electrode's voltage from a first voltage to a second voltage, wherein a voltage difference between the second voltage and the data voltage is the over driving voltage, wherein the voltage difference between the second voltage and the data voltage is larger than the voltage difference between the first voltage and the date voltage, and the polarity of the data voltage is reversed to the polarity of the second voltage;

selecting at least some of the pixels to write color data based on a color image signal after the black data is written into the pixels; and turning on a backlight based on the color data.

17. The driving method of claim 16, wherein the step of writing black data to the pixels further comprises transferring the black data with a first polarity in the first time to the corresponding pixels through the data lines, and to transfer the black data with a second polarity reversed to the first polarity in the second time to the corresponding pixels through the data lines.

18. The driving method of claim 16, wherein the gate lines of the first group are the odd-numbered gate lines, and the gate lines of the second group are the even-numbered gate lines.

19. The driving method of claim 16, wherein the data lines are grouped into a first group and a second group, the data lines of the first group transfers the black data with a first polarity and the data lines of the second groups transfers the black data with a second polarity to the pixels in the first time, and the data lines of the first group transfers the black data with the second polarity and the data lines of the second groups transfers the black data with the first polarity to the pixels in the second time, wherein the first polarity is reversed to the second polarity.

* * * * *